US008688263B2

(12) United States Patent
Winkler et al.

(10) Patent No.: US 8,688,263 B2
(45) Date of Patent: Apr. 1, 2014

(54) APPARATUS AND METHOD FOR INSERTING DOCUMENTS IN ORDER-PICKING SYSTEMS

(75) Inventors: Max Winkler, Graz (AT); Robert Fankhauser, Dobl (AT)

(73) Assignee: SSI Schaefer Peem GmbH, Graz (AT)

( * ) Notice: Subject to any disclaimer, the term of this patent is extended or adjusted under 35 U.S.C. 154(b) by 132 days.

(21) Appl. No.: 13/177,994

(22) Filed: Jul. 7, 2011

(65) Prior Publication Data

US 2011/0288678 A1 Nov. 24, 2011

Related U.S. Application Data

(63) Continuation of application No. PCT/EP2009/009274, filed on Dec. 24, 2009.

(30) Foreign Application Priority Data

Jan. 9, 2009 (DE) ..... 10 2009 004 640

(51) Int. Cl.
*G06F 7/00* (2006.01)
*A21C 15/04* (2006.01)

(52) U.S. Cl.
USPC ..... 700/220; 700/219; 700/221; 700/222; 271/214; 53/435; 53/443; 53/154

(58) Field of Classification Search
None
See application file for complete search history.

(56) References Cited

U.S. PATENT DOCUMENTS

| | | | | |
|---|---|---|---|---|
| 3,205,794 | A | 9/1965 | Califano et al. | |
| 4,627,222 | A * | 12/1986 | Cantile | 53/443 |
| 5,803,704 | A | 9/1998 | Lazzarotti | |
| 7,600,751 | B2 | 10/2009 | Rozenfeld | |
| 2008/0289301 | A1 * | 11/2008 | Gallimore | 53/435 |

FOREIGN PATENT DOCUMENTS

EP 1792 862 A1 6/2007

* cited by examiner

*Primary Examiner* — Yolanda Jones
(74) *Attorney, Agent, or Firm* — Renner, Otto, Boisselle & Sklar, LLP

(57) ABSTRACT

The present invention discloses a method and a system for inserting documents (32) in an automated manner into load supports, in particular into containers (30), which are transported by means of a conveyor (26) in an order-picking system (10), comprising: a document guiding device (40) for storing one, preferably single, document (32), and for mechanically guiding same to an assigned load support, which passes the document insertion apparatus (12;12') by means of the conveyor (26) in an automated manner such that the document (32) can be moved actively into the assigned load support, wherein the document guiding device (40) comprises receiving members (42, 44; 90) which are arranged substantially oppositely horizontal and are mounted movably relative to each other, wherein in a receiving position (FIG. 6A) the receiving members (42, 44; 90) receive the document (32) in a space therebetween.

21 Claims, 7 Drawing Sheets

APPARATUS AND METHOD FOR INSERTING DOCUMENTS IN ORDER-PICKING SYSTEMS

RELATED APPLICATIONS

This is a continuation application of the co-pending International application WO 2010/078947 A1 (PCT/EP2009/009274) filed on 24 Dec. 2009 which claims priority of the German patent application DE 10 2009 004 640.2 filed on 1 Jan. 2009 which is fully incorporated here by reference.

BACKGROUND OF THE INVENTION

The present invention relates to a document insertion apparatus for automatically inserting documents into load supports or load make-up accessories, in particular into containers, bins or trays, which are transported by means of a conveyor in an order-picking system. The present invention further relates to a method for inserting a document into an associated load support.

RELATED PRIOR ART

With conventional document insertion apparatuses such as the ones sold by the applicant, a document is printed by means of a conventional printer and subsequently buffered in a magazine coupled to the printer which can buffer, for example, up to eight different documents. Typically, laser printers are used. For ensuring that the document is already printed when a container being assigned to the document, which is transported on a conveyor such as a roller conveyor, has passed the printer an identification number of the container is already detected relatively early. Typically, the container identification happens at a location which is located, for example, up to ten container lengths upstream relative to a hand-over point where the documents are inserted into the containers. This is necessary for retrieving the document from an upper level controlling computer, such as a warehouse management computer, and for providing sufficient time to the document printer in order to print the document. In particular, warming-up periods of the printer need to be considered.

It is considered as a disadvantage that the distance between the identification location and the inserting location is relatively long. Failures (e.g. traffic jams, an unpredictable removal of a container from the container stream or similar) can happen on the way between the identification location and the insertion location so that instead of an expected container rather any container or another container arrives at the hand-over location. In this case, the document printer is no longer capable of reacting on such a failure. Then the entire system needs to be stopped or the failure is corrected in a manual failure handling station being located downstream.

If each document comprises a number of pages or sheets, conventional document insertion apparatuses rapidly reach their limit when sheet numbers increase for each container, i.e. the throughput (container/hour) heavily decreases. If in this situation also a failure occurs during the container transport between the identification location and the insertion location this can have disastrous effects.

Existing document printing systems are relatively expensive since on the one hand a lot of mechanics and on the other hand much pneumatics is utilized. Thus, it is quite usual to connect a document conveyor to the printer instead of a document magazine. The document-conveyor track then functions as storage, and dispenses documents into the containers at the end thereof. The putting-up and the starting up of this (additional) document-conveyor track is cost intensive, however. Further, such a document-conveyor track represents another possible source of failures, and additionally requires space.

If no document conveyor is provided, typically a pneumatically operated document magazine is provided. In order to allow opening and closing of individual ducts of a magazine a pneumatic circuit is required. The pneumatic circuit in turn increases the costs and the susceptibility in the light of malfunctions.

The patent application US 2008/0289301 A1 discloses a device for delivering coupons to containers. Thereby one coupon is delivered to each container. The delivery happens by a horizontal ejection. On this occasion the coupons are clamped between two belts vertically opposing each other, which in turn are oppositely driven in order to eject one coupon in a lateral manner respectively. The coupons are printed in advance, and are provided in terms of an endless web on a roller. The device of the document US 2008/0289301 A1 additionally comprises a device for separating the endlessly provided coupons before the separated coupons are delivered to the belt.

SUMMARY OF THE INVENTION

In the light of this it is one object of the present invention to provide an improved method and an improved apparatus for automatically inserting documents into load supports.

It is another object of the invention that the system should is scalable well and equipped in a redundant manner.

A still further object is a high reliability as well as utilization of as less as possible mechanical components is desirable.

It is still another object that the system is cheap and allows high throughputs.

According to one aspect of the invention a document insertion apparatus for automatically inserting documents into load supports, in particular containers or trays, which are transported in an order-picking system by means of a conveyor, comprises: a document guiding device for storing a, particularly one single, document including at least one document sheet, and for mechanically guiding the document to an assigned load support which automatically passes the document insertion apparatus on the conveyor so that the document can be actively moved into the load support assigned thereto, wherein the document guiding device comprises two receiving members which are substantially facing each other horizontally and supported in a movably to each other and which receive the document in a space between each other in their receiving position, and an actuating member, which moves the receiving members towards their delivery position in which the document is delivered to the assigned load support; at least one sensor, wherein a first sensor (e.g. a scanner) is configured and arranged such that the load support can be identified in front of, preferably immediately in front of, the document insertion apparatus; and a controlling device, which is connected to the sensors for outputting a document print command to the printer in dependence on a signal of the first sensor identifying each of the load supports, in order to cause print of the document being assigned to the identified load support.

Failures are reduced by identifying the load support only immediately in front of the document insertion apparatus, because the load supports cannot get into trouble any more on their way to the document insertion apparatus. Even in case of wrong prints or paper jams wrong assignments between documents and load supports do not occur. A paper jam or a misprint can be removed without any problem, in particular without resulting in confusion with regard to the load supports.

Since the documents are given into the load supports directly, i.e. without simultaneous buffering of documents belonging to different load supports, documents having a greater number of sheets can be delivered without any problem. The document insertion preferably happens horizontally.

The document insertion apparatus in accordance with the present invention operates extremely reliable (in average one failure per 10,000 sheets). The invention is scalable without any problems. i.e. a number of document insertion apparatuses can be coupled sequentially to one and the same conveyor track (conveyor) for increasing the throughput (preferably at the same number of sheets for each document).

The load-support conveyor is built very short since a so-called sign-in track, like the one known in the prior art having, for example, a length of eight containers, is not required any more.

Less mechanical components are used which, however, are simple thereby resulting in a higher reliability.

The receiving members are preferably realized by bucket wheels which are mounted in a rotatable manner and in the receiving position the buckets thereof are closed towards the assigned load supports.

(Multi-sectional) bucket wheels having, for example, two to four buckets per wheel represent simple mechanical components, which on the other hand safely receive the sheets of a document and on the other hand safely guide same towards the load support during an insertion process.

Apart from this it is advantageous if the bucket wheels are operated by means of a single drive such that the bucket wheels rotate from their receiving position in an opposite direction of rotations, wherein preferably the bucket wheels always rotate in the respectively same direction in order to get into their respective delivery position.

The bucket wheels are rotated in order to be moved from their receiving position into their delivery position. The advantage of bucket wheels is that if a first bucket wheel pair has been rotated from the receiving position into the delivery position the subsequent bucket wheel pair in turn is simultaneously rotated to its receiving position. Moving the pairs of bucket wheels back and forth is not required resulting in a gain of time. This increases the throughput.

Since only one drive is used the system is less susceptible to failures with regard to synchronization. The synchronization of the receiving members typically happens by moving, for example, the bucket wheels by means of a traction device, particularly a driving belt, which is guided around parallel axes of the bucket wheels in an opposite sense of rotation. Preferably, the drive is an electric motor.

In this manner the utilization of a pneumatic circuit can be completely omitted. This in turn increases the reliability. Thereby, also the acquisition costs are reduced.

Alternatively, the receiving members are formed as supported flaps.

By using flaps the above-mentioned advantages can be achieved as well, except that the flaps need to be moved back and forth in order to get to the receiving position or delivery position.

If pivotal flaps are used, it is advantageous to use a stamp as an actuating member for bringing the flaps from above to their delivery position. Then, the flaps can be brought again into their receiving position by means of a restoring mechanism, in particular a spring device.

This system in turn is—in comparison to the prior art—characterized in that only mechanical components—and thus no pneumatic components—are used.

With a preferred embodiment a second sensor is provided which is arranged and configured such that a number of sheets belonging to one document can be counted and checked, wherein the controlling device interrupts the insertion of documents in dependence on signals from the second sensor, if the number of document sheets deviates from a predetermined number, or causes the insertion of documents, if the number of document sheets matches the predetermined number.

In this manner it can be controlled whether all sheets of one document are actually present. This measure in turn turns off one of the frequent failure sources.

Further it is preferred if a third sensor is provided which is arranged and configured for checking whether the right document is located in the receiving members for being inserted.

Preferably, a bar code scanner is used for identifying the document in the receiving position.

In this manner failures can be detected in the printing device itself and can be eliminated in time.

Also, it is advantageous if a fourth sensor is provided which is arranged and configured for checking whether the receiving members are in the respectively right position.

With this measure it is possible to check whether the receiving members have run through a complete motion cycle during the preceding insertion of one document. If the receiving members have not been moved entirely to their receiving position, a mechanical jam can happen preventing the insertion of documents into the receiving members. Such a failure can be detected immediately or in good time by the fourth sensor.

According to another object of the invention an order-picking system is proposed, having at least one document insertion apparatus in accordance with the present invention and having a conveyor for transporting load supports, wherein a number of document insertion apparatuses share one common single first sensor (e.g. scanner) being arranged one accumulation length upstream relative to the first document insertion apparatus for each document insertion apparatus provided.

If the order-picking system is provided, for example, with two document insertion apparatuses, it is recommended to place the identification location by the length of two load supports in front of the first document insertion apparatus. Thus, it is possible, to identify two load supports for each cycle so that each document insertion apparatus can print one document for one of the load supports. It is clear that the identification location is preferably shifted correspondingly further upstream if the number of document insertion apparatuses increases.

Alternatively, the document insertion apparatus can be bypassed by another conveyor if, for example, invoices are printed as documents. Typically, only the last container of a series of containers gets added the invoice. If a container series includes, for example, five containers, this means that the fifth container is provided with one document. i.e. an invoice. For avoiding the passage of unnecessary many containers at the document insertion apparatus, i.e. for letting only pass such containers at the document insertion apparatus which are to be provided actually with one document, a bypass-conveyor track (conveyor) is provided on which the containers run along the document insertion apparatus without detour. In this manner the throughput can be increased.

According to still another object of the invention a method is proposed for inserting documents into an assigned load support, wherein the method comprises the following steps: detecting a load support identification number immediately, preferably one accumulation length, in front of a document insertion apparatus; retrieving a document assigned to the identification number from a controlling device; printing by means of a printing device and delivering the assigned document to a document guiding device of the document insertion apparatus; checking whether the document is complete; delivering the document if complete; wherein the delivery comprises an opposing movement of receiving members of the document guiding device for guiding the document mechanically into the assigned load support.

Failures can be prevented by reading the identification number of the load support only immediately in front of the document insertion apparatus, the failures being caused by the length of the sign-in track (advance track) typically used in the prior art between identification and insertion.

BRIEF DESCRIPTION OF THE DRAWINGS

It is clear that the above-mentioned and hereinafter still to be explained features cannot only be used in the respectively given combination but also in other combinations or alone without departing from the scope of the present invention.

Embodiments of the invention are illustrated in the drawing and will be explained in more detail in the following description.

PREFERRED EMBODIMENTS OF THE INVENTION

Figure 1:
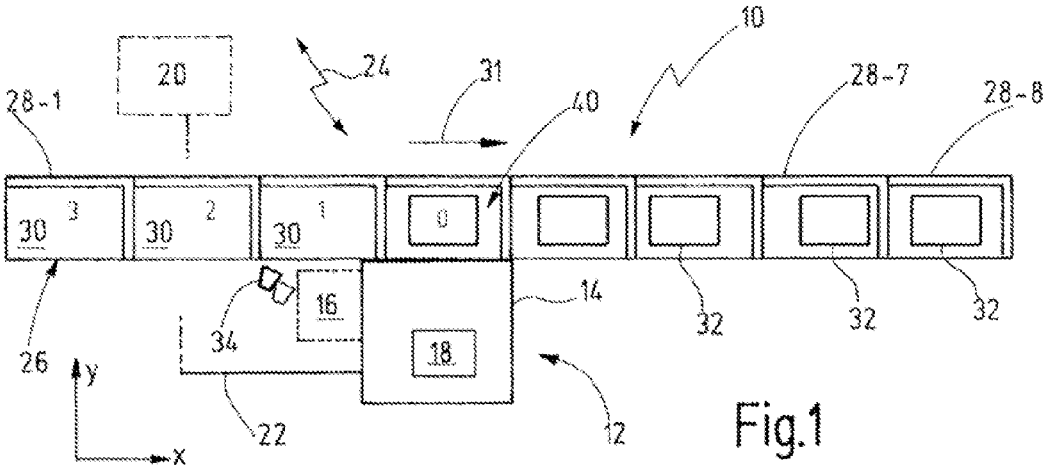
FIG. 1 shows a top view of a part of an order-picking system comprising a document insertion apparatus in accordance with the invention.

In the following description identical features will be designated by the same reference numerals. Similar features are designated by slightly varying reference numerals.

FIG. 1 shows a top view of an order-picking system 10 comprising a document insertion apparatus 12 in accordance with the present invention. The document insertion apparatus 12 comprises a printer 14 (e.g. laser printer, ink jet printer, etc.) including a paper storage 16 and an (integrated) controlling device 18. The controlling device 18 can also be provided externally in terms of a stored-program controller (SPC) which can communicate with an upper level computer 20, such as a warehouse management computer (WMC) or a material flow computer (MFC), via lines 22 such as a bus system and/or wireless communication links 24. The document insertion apparatus 12 further comprises a document guiding device 40 which will be explained in greater detail with reference to FIGS. 2 to 4.

The document insertion apparatus 12 of FIG. 1 is arranged adjacently to a conveyor 26. The conveyor 26 can be implemented in terms of a roller conveyor, belt conveyor, or similar. In particular, the conveyor 26 is arranged in segments. The part of the conveyor 26 being illustrated in FIG. 1 comprises, for example, eight conveyor segments 28-1 to 28-8. Each of the conveyor segments 28 is adapted to receive at least one load support 30 such as a container, tray, cardboard box, or similar. In the following, the present invention will be described in more detail by using containers as load supports, wherein it is clear that other load supports 30 can be used in the same way.

The containers 30 are transported downstream past the document insertion apparatus 12 on the segments 28 along the direction X, as illustrated by means of an arrow 31. The segments 28-4 to 28-1 are provided with the figures 0 to 3 (from the right to the left) for illustrating the distance of one container 30 relative to the document insertion apparatus 12. Hence, the container 30 on the conveyor segment 28-1 is only three positions apart from the document insertion apparatus 12. In FIG. 1, documents are designated with reference numeral 32. Each of the containers 30 on the conveyor segments 28-3 to 28-8 is respectively provided with one document 32. One document 32 can comprise one or more sheets. A document is an accompanying paper which is added for the purpose of identifying a delivery of goods, the sender and the receiver. However, the document 32 can also be an invoice.

In dependence on the content of a document 32 the document insertion apparatus 12 is positioned in the order-picking systems 10 either at the beginning or at the end thereof. The document insertion apparatus 12 is positioned at the beginning if empty containers 30 are to be filled with articles in accordance with a picking order by means of the documents 32. In this case, the documents 32 signal to the operator how many articles of a specific type belong to a respective one of the containers 30. In case of invoices, the document insertion apparatus 12 is only arranged at the end, i.e. nearby a goods issue of the order-picking system 10. In this case, typically only the last container 30 of a container series gets one invoice added, assuming that an order comprises several containers 30. However, this embodiment will be explained in greater detail with reference to FIG. 11.

Figure 2:
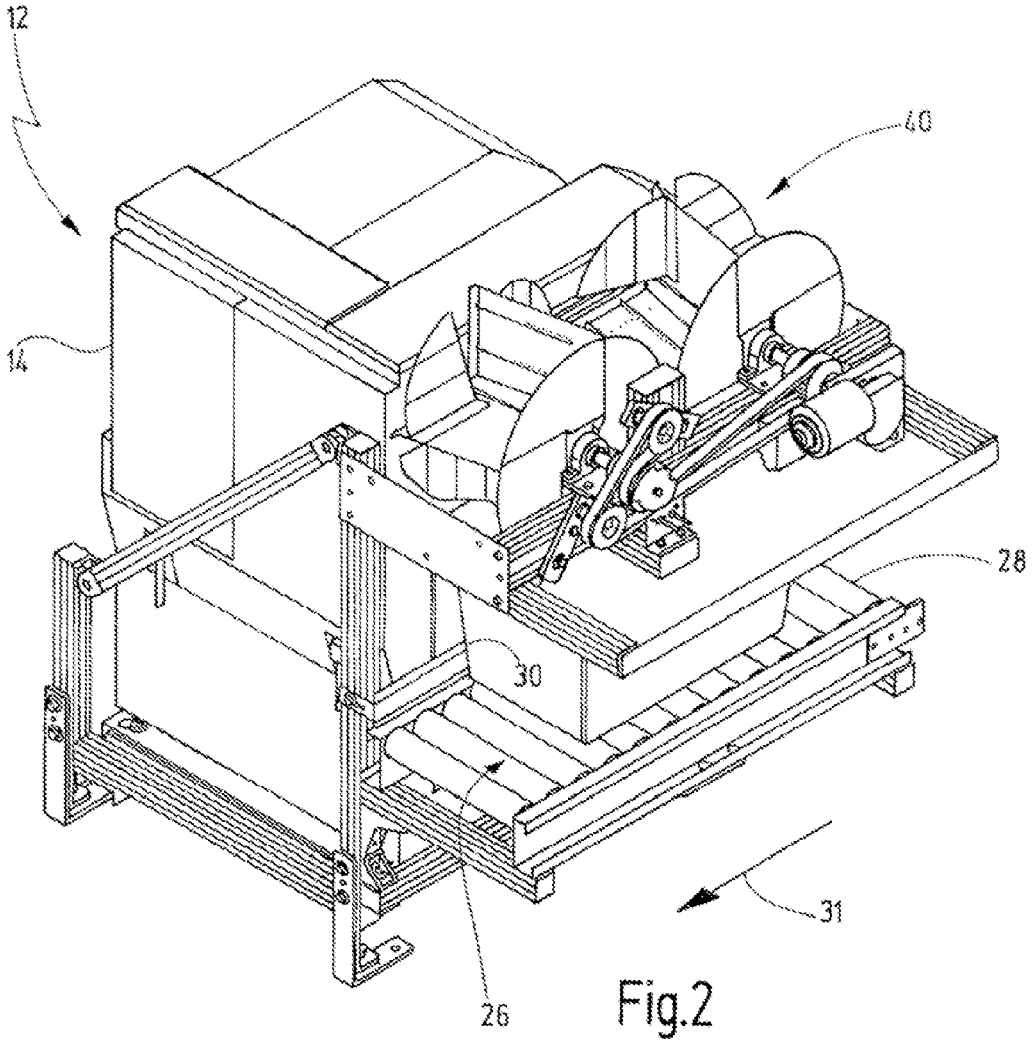
FIG. 2 shows a perspective view of the document insertion apparatus of FIG. 1.

With reference to FIG. 2 a perspective view of the document insertion apparatus 12 being illustrated in FIG. 1 is shown. In FIG. 2 the document guiding device 40 is illustrated with an open housing and will be explained in greater detail in the context of FIG. 3. In FIG. 2 one conveyor segment 28 of the conveyor 26 is recognizable which is implemented in terms of a roller conveyor here. The container 30 is guided beneath the document guiding device in order to be not equipped with a document 32 (which is not illustrated here). The document 32 is output by the printer 14 in an upper region, received by the document guiding device 40, and subsequently delivered through mechanical guidance of the document guiding device 40 into the container 30 being arranged beneath. It is clear that the presently shown arrangement can also use gravity for putting the documents into the containers 30. However, in the same way it would be possible to guide the container 30 laterally past the document guiding device 40 for putting the document into the container 30.

Figure 3:
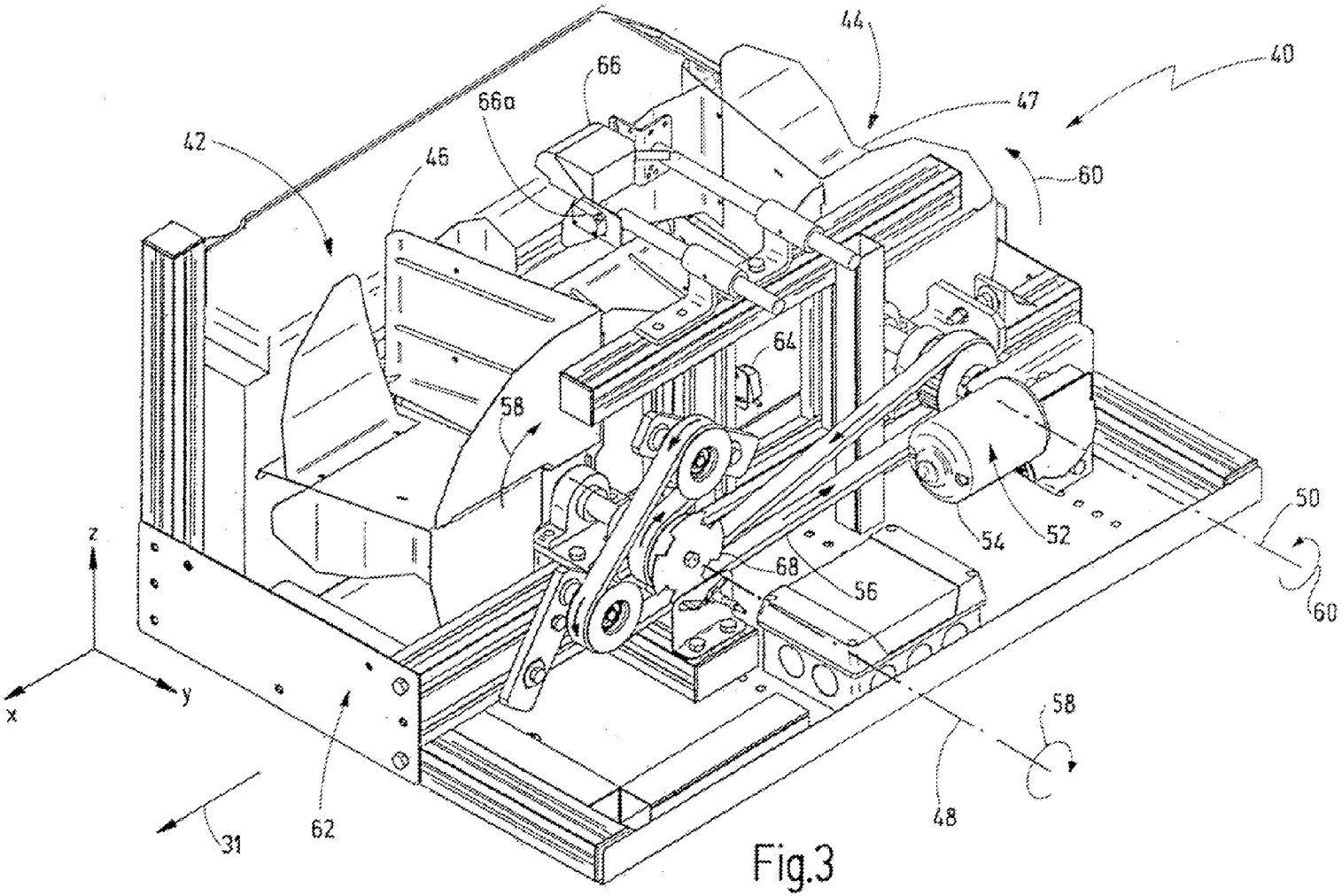
FIG. 3 shows a perspective view of a document guiding device of the document insertion apparatus of FIGS. 1 and 2.

With reference to FIG. 3 the document guiding device 40 of FIG. 2 is shown in an isolated manner but in greater detail.

In the present example, the document guiding device 40 comprises first and second receiving members 42, 44 which are implemented in terms of bucket wheels 46, 47 in FIG. 3. The bucket wheels 46, 47 can comprise several members. In the present example of FIG. 3 the bucket wheels have four members, i.e. each of the bucket wheels 46, 47 respectively comprises four buckets. It is clear that the bucket wheels 46, 47 could also comprise a different number of buckets with a corresponding transmission ratio such as three buckets at the first wheel and four buckets at the second wheel.

The bucket wheels 46, 47 can be rotated around axes 48 and 50. The axes 48, 50 are substantially orientated parallel to each other. The axes 48, 50 are orientated, in the present example, along the axis Y, i.e. transversally relative to the conveying direction 31.

The bucket wheels 46, 47 are orientated to each other such that two pairs of bucket blades are preferably arranged in a horizontal plane and the bucket wheels can be rotated freely with respect to each other, but preferably in a synchronized manner. In the example of FIG. 3 the first receiving member 42 rotates around its axis 48 in a direction of rotation 58 (clockwise in the illustration of FIG. 3). The second receiving member 44 rotates around the axis 50 in an opposite direction of rotation 60 (counter-clockwise in the illustration of FIG. 3). In this manner neighbouring pairs of bucket blades of the first and second bucket wheels 46, 47 synchronically move downwards, i.e. towards the container 30 (cf. FIG. 2).

For generating this movement, which is preferably synchronous, a (preferably single) drive 52 is used which is implemented in terms of an electric motor 54 in the present example of FIG. 3. The electric motor 54 drives a traction device 56 such as a serrated belt via a gear wheel which is presently not shown in greater detail. The serrated belt 56 is guided such that it drives the gear wheels which are connected to the axes 48 and 50 in a non-rotating manner so that the bucket wheels 46, 47 are rotated oppositely. The direction of movement of the serrated belt 56 is indicated by dark arrows in FIG. 3. The utilization of one single motor or drive 52 is advantageous in that relatively few components are used for outputting the document 32 and moving the receiving members 42, 44. The pneumatic circuit, which is needed in the prior art for opening and closing output flaps of document magazines, is not needed in this case. Also, a plurality of valves is not required for releasing the flaps. With the present invention the receiving members 42, 44 are mechanically twisted in a simple manner resulting in the release of one document.

In order to verify whether a document 32 comprises a required number of document sheets, a sensor 64 such as a light probe or a light barrier is provided on a frame 62 of the document guiding device 40, the sensor 64 being preferably arranged in a horizontal plane (plane XY) where also document sheets are output by the printer 14 (cf. FIG. 2) which is not illustrated in FIG. 3. A number of light interruptions is representative of the number of sheets being output. In this manner it is possible to count the sheets of one document 32.

In order to ensure that the right document 32 was printed another sensor 66 such as a bar code scanner can be used. In FIG. 3 the bar code scanner 66 is arranged so that it substantially reads along the direction Z. Since the document 32 is received preferably in the horizontal plane (XY), hence a good readability of bar codes is ensured which are printed on the documents 32. In this manner it can be assured that the right document 32 was printed for the container 30 (cf. FIG. 2) which is arranged beneath the document guiding device 40.

Another safety feature can require another sensor 68 such as a Reed contact. A Reed contact can verify the position of the bucket wheels 46, 47 which are preferably made of metal in this case. If one of the bucket wheels, in this case the bucket wheel 46, moves through the sensor area of the sensor 68, it can be determined whether the bucket wheel 46 has rotated in the right direction and about the right angle. If the bucket wheel 46 has rotated in the right direction and about the right angle. Also the second bucket wheel 46 has rotated correctly as a logical consequence of the drive by means of the traction device 56. By checking the position of the bucket wheels 46, 47, it can be prevented that sheets cannot be delivered from the printer 14 to the next free pair of bucket blades, and thereby resulting in a paper jam, if a delivery device (in this case one rotation of the bucket wheels 46, 47 about 90 degree) has not completely run through.

Figure 4:
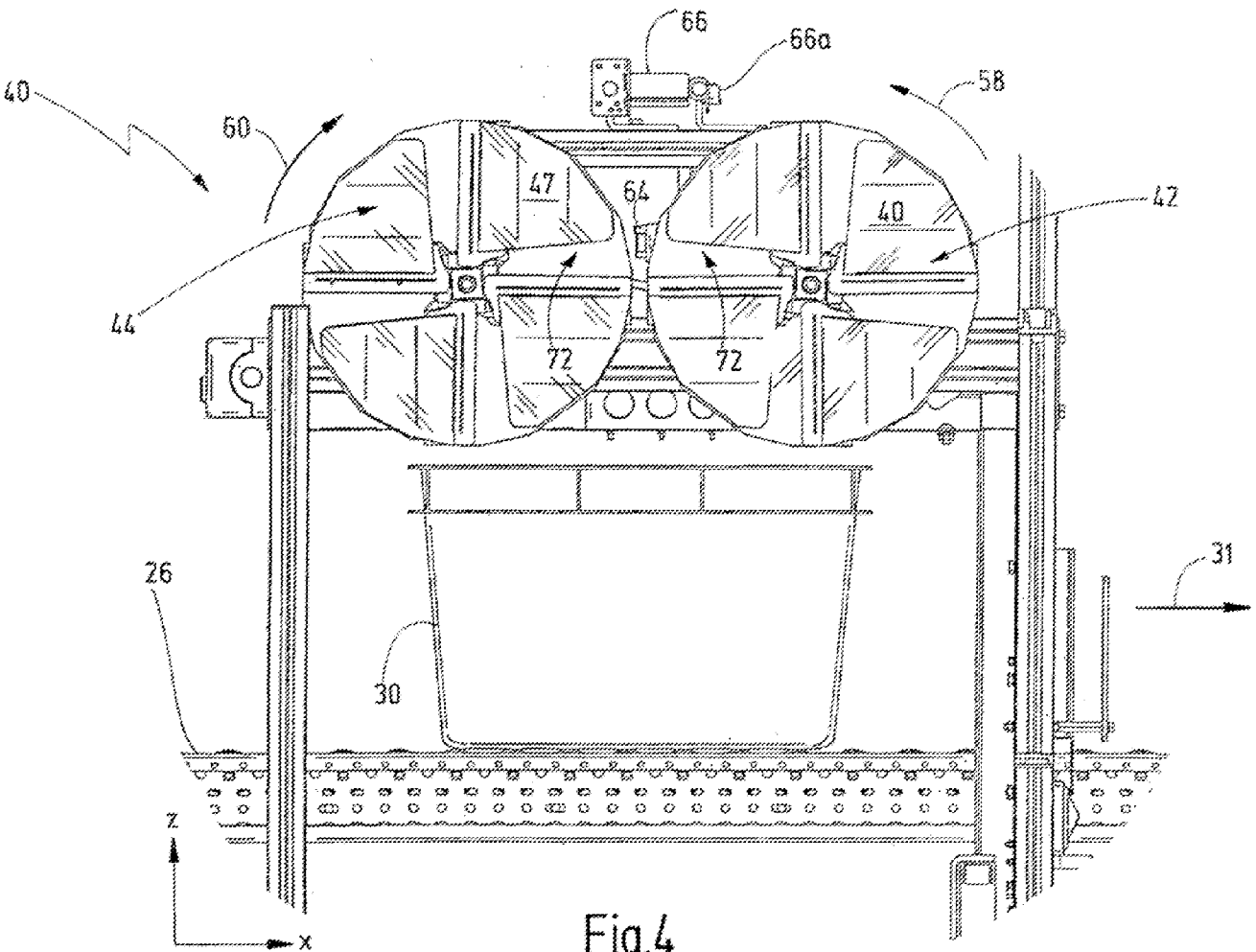
FIG. 4 shows a side view of the document guiding device of FIG. 4 including a container being passed beneath the document guiding device, as seen from the point of view of the printing device.

With reference to FIG. 4 the document guiding device 40 of FIG. 3 is shown from the point of view of the printer 14 (cf. FIG. 2). Beneath the document guiding device 40, the bucket wheels 46, 47 are clearly recognizable, the container 30 is passed through along the direction 31. The passing through is possible in both directions with the same construction due to the symmetry of the machine. The container 30 can move continuously beneath the document guiding device 40 on the conveyor 26 without stopping. However, the container 30 can also stay during the inserting of the document beneath the document guiding device 40 as long as the insertion lasts. In particular, another sensor (being not illustrated here) can be used for this purpose, in order to check the position of the container 30 beneath the document guiding device 40. This sensor can also be used for stopping the conveyor 26 if the hand-over point or the hand-over position is reached. In the light of the prior art the present invention is also characterized in that as few as possible sensors are used so that as few as possible data needs to be processed, in order to save time and increase reliability.

The sensor 64 has a free line of sight between the bucket wheels 46, 47 on one dispenser slot of the printer 14. If the printer 14 dispenses a document sheet, for example, a light beam of the sensor 64 is interrupted for a short time since the sheet falls in a space between two bucket pairs assigned to each other as it will be described hereinafter in greater detail. The sensor 64 preferably measures along the direction Y, i.e. perpendicular to the drawing plane of FIG. 4.

The sensors 66 and **66*a* are preferably arranged so that they substantially operate in the direction of Z. The sensor 66*a*** can check whether the compartment was empty before the insertion process.

The dispenser slot of the printer 14 is preferably arranged such that it dispenses sheets in a gap 72 between neighbouring buckets of the bucket wheels 46, 47.

Figure 5:
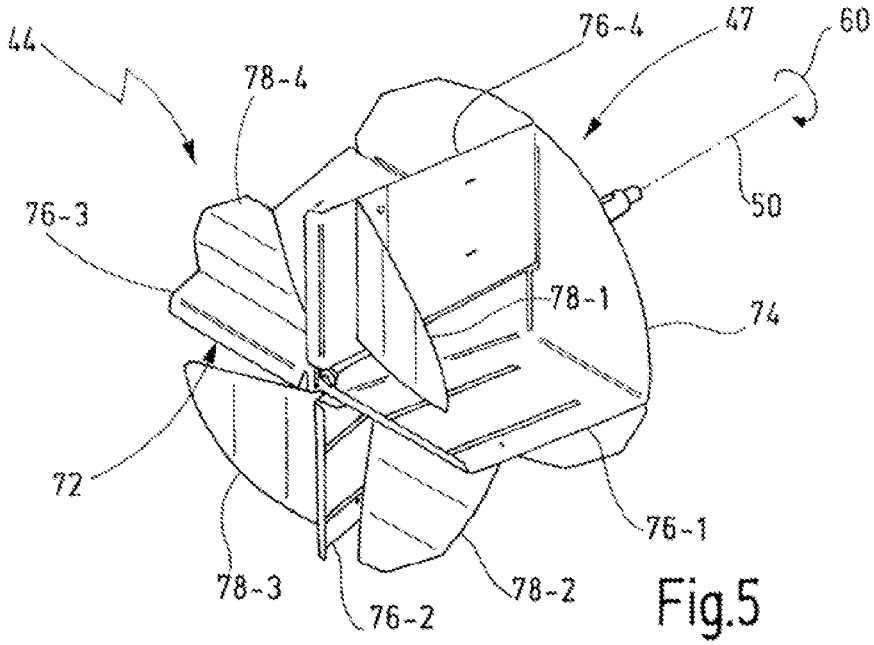
FIG. 5 shows a perspective view of a receiving member, i.e. a bucket wheel, of the document insertion apparatus of the preceding figures.

FIG. 5 shows in a perspective view the receiving member 44, being illustrated in FIG. 4 on the left, and the bucket wheel 47 in an isolated manner.

The bucket wheel 47 preferably comprises a base area which preferably is substantially circular and forms a rear wall 74 of the bucket wheels 47, which is rotatably mounted around its axis 50 in the direction of rotation 60 on the frame 62 (cf. FIG. 3).

In the present case, the bucket wheel 47 comprises four bucket blades 76-1, . . . , 76-4 being orientated substantially perpendicular to the rear side 74. Preferably the angle is not exactly 90° providing a certain tolerance in the vertical direction when the documents are inserted. However, the bucket blades 76 can also be inclined slightly relative to the vertical. It is clear that more or less of the bucket blades 76 can be used. However, preferably three or four bucket blades 76 are utilized.

Preferably, each of the bucket blades 76 is connected to a side guiding element 78 arranged oppositely to the rear side 74. The side guiding elements 78-1, . . . , 78-4 of FIG. 5 are substantially located in a plane being orientated parallel to the back side 74. However, the side guiding elements 78 can also be inclined slightly relative to the rear side 74.

Respectively one gap 72 is formed between the bucket blades 76 and the side guiding elements 78 of a neighbouring bucket blade. Thus, one of the gaps 72 is formed, for example, between the side guiding element 78-1 of the bucket blade 76-4 and the bucket blade 76-1 of the neighbouring bucket.

The bucket wheel 47 is preferably made of sheet metal, wherein the individual elements of the bucket wheel 47 are formed or crimped such that the document sheets, which are put into one of the bucket wheel spaces being defined respectively between two neighbouring bucket blades and one associated side guiding element as well as one corresponding part of the rear side 74 cannot fall out unintentionally. Therefore, neighbouring bucket blades (e.g. 76-1 and 76-4) together form an area with almost no transitions.

Figure 6A:
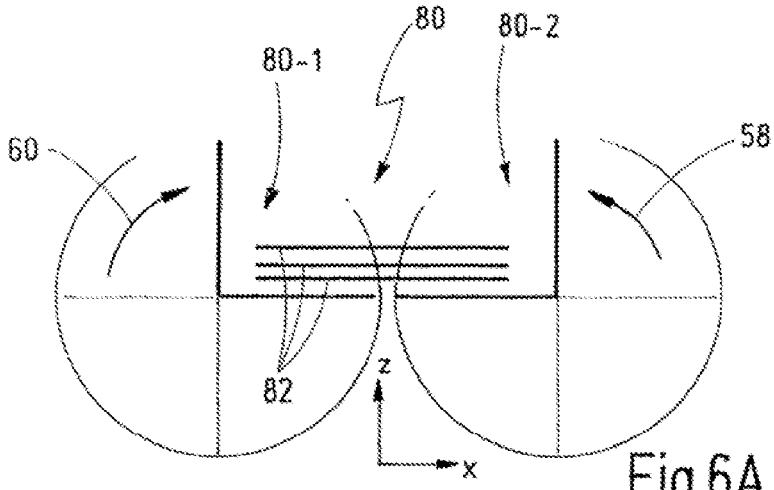
FIG. 6 shows a side view of a drastically schematized pair of receiving members in a receiving position (FIG. 6A) and delivery position (FIG. 6B)
Figure 6B:
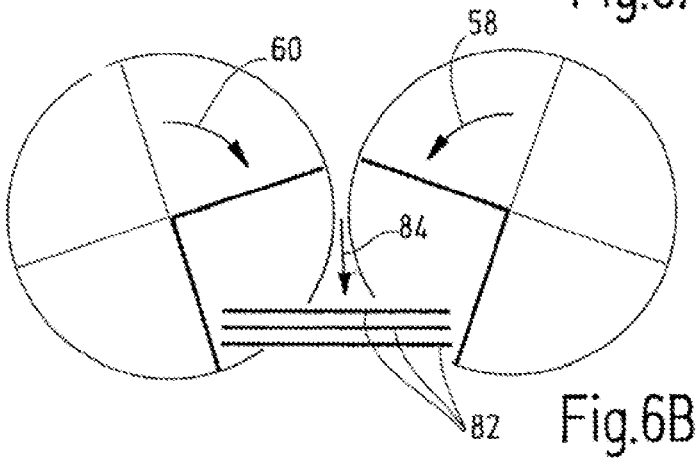

With reference to FIGS. 6A and 6B two bucket wheels, being formed by four parts respectively, are shown in a strongly schematized manner in a side view similar to the one of FIG. 4. FIG. 6A shows the bucket wheels in one of four receiving positions. FIG. 6B shows the same bucket wheel briefly before a delivery position.

In FIGS. 6A and 6B a first bucket wheel pair 80 comprising a first bucket 80-1 of the bucket wheel being illustrated on the left and a second bucket 80-2 of the bucket wheel being illustrated on the right. The buckets are illustrated in an emphasized manner by means of bold lines for the sake of a better understanding. In FIG. 6A the bucket wheel pair 80 has already received three document sheets in its receiving position. In the receiving position the lower bucket blade of each bucket 80-1, 80-2 is preferably located in a plane which is substantially orientated horizontally. It is clear that the lower bucket blades of the buckets 80-1, 80-2 do not necessarily need to be in the horizontal plane. Slight angular deviations are acceptable.

As soon as all of the document sheets 82 of one document 30 are present in the receiving space, which is defined by the buckets 80-1 and 80-2, the bucket wheels are turned in opposite directions around their respective axes. The left bucket wheel is presently turned in a clockwise direction, i.e. along the direction of rotation 60. The right bucket wheel is turned against the clockwise direction. i.e. alone the direction of rotation 58.

FIG. 6B shows the state of the buckets 80-1 and 80-2 briefly before completing one rotation cycle which is presently realized by a 90 degree rotation, if four bucket blades are used. The lower bucket blades, which are orientated horizontally in FIG. 6A, have almost rotated to a perpendicular or vertical orientation. The bucket blades originally orientated vertically have almost turned into the horizontal orientation. It can be seen that the document 30 consisting of three document sheets 82 is guided along the direction of an arrow 84 mechanically and vertically downwards due to gravity and the mechanical guidance of the bucket blades. As soon as one rotation cycle (90 degree rotation) is completed, the clear distance between the bucket blades, which are then orientated vertically, of the bucket wheel pair 80 is bigger than the length of the document sheets 82, so that they are released in the present case downwards towards the container 30 (cf. FIG. 4).

Then the entire process can start from the beginning since another bucket wheel pair, which follows the bucket pair 80, is now in its receiving position whereas the bucket wheel pair 80 being underlined bold is in its delivery position.

It is clear that the receiving space defined by the buckets 80-1 and 80-2 can be varied arbitrarily with regard to the geometrical dimensions thereof. However, the space should be adapted preferably to the paper size being preferably used, namely such that the length of the paper is slightly smaller than the length of the receiving space for guiding the documents 30 safely downwards during one rotation cycle.

It is clear that the shape of the receiving members 42, 44 which was explained up to now in terms of bucket wheels turning around an axis in a horizontal plane can be varied. Also, the orientation of the rotation axes 48, 50 can be changed. Hence, it is possible, for example, to orientate the rotation axes 48, 50 vertically so that the document guiding device 40 receives the documents 32, for example, from a printer 14 being arranged at the left-hand side, and delivers to the right into adjacent containers 30 so that the essential movement happens when the documents are inserted in the horizontal.

Figure 7:
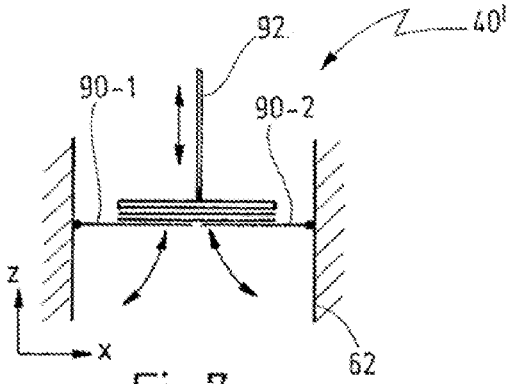
FIG. 7 shows another embodiment of a document guiding device in a side view.

Another embodiment of another document guiding device 40' is shown in FIG. 7 in a schematized manner.

Instead of providing endless rotating bucket wheels 46, 47, in the present case flaps 90 are provided, which are pivotally supported on the frame 62. A first flap 90-1 and a second flap 90-2 are substantially orientated horizontally when there are in their receiving position as shown in FIG. 7, and define a (small) gap between each other.

Document sheets can be delivered to the receiving space from above, which is restricted by the flaps 90-1, 90-2 and the frame 62. As soon as all of the document sheets of one document are completely present in the receiving space and the corresponding associated container 30 is positioned beneath the flaps 90-1, 90-2, the document is pressed downwards (−Z) by the aid of a stamp 92, which is represented in this case by an actuating member, capable of moving substantially back and forth along the direction of Z. The flaps 90-1 and 90-2 then pivot downwards as indicated by two curved double arrows. The removed flaps 90-1 and 90-2 then release the path of the document 32 towards the container 30 (not depicted here). The flaps 90-1, 90-2 typically comprise a restoring mechanism such as a correspondingly biased spring in the rotation axis thereof for returning the flaps 90-1, 90-2 after a successful delivery of the document 32 from the delivery position to the receiving position.

Figure 8:
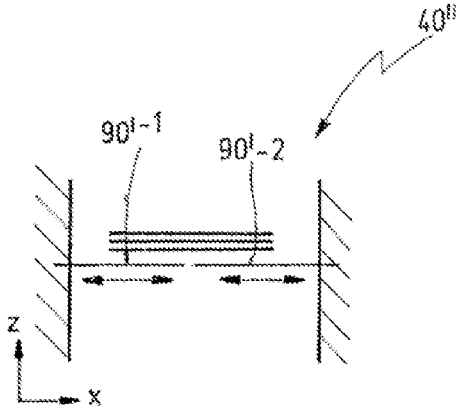
FIG. 8 shows still another embodiment of a document guiding device in a side view.

With reference to FIG. 8 a still further embodiment 40" of the document guiding device in accordance with the present invention is shown. The document guiding device 40" of FIG. 8 is constructed similar like the document guiding device 40' of FIG. 7. In this case also two flaps 90'-1 and 90'-2 are provided which cannot be pivoted but are supported in their plane in a movable manner. The flaps 90'-1, 90'-2 can be moved by means of an actuating member, which is not depicted here, from the receiving position shown in FIG. 8 to a delivery position, which is not shown here, in order to release the downward path of the document.

It is clear that the actuating member 92 of FIG. 7 as well as the actuating member of FIG. 8, which is not depicted, can be constructed similar to the actuating member of FIG. 3 which comprises the drive 52 and the traction device 56.

Figure 9:
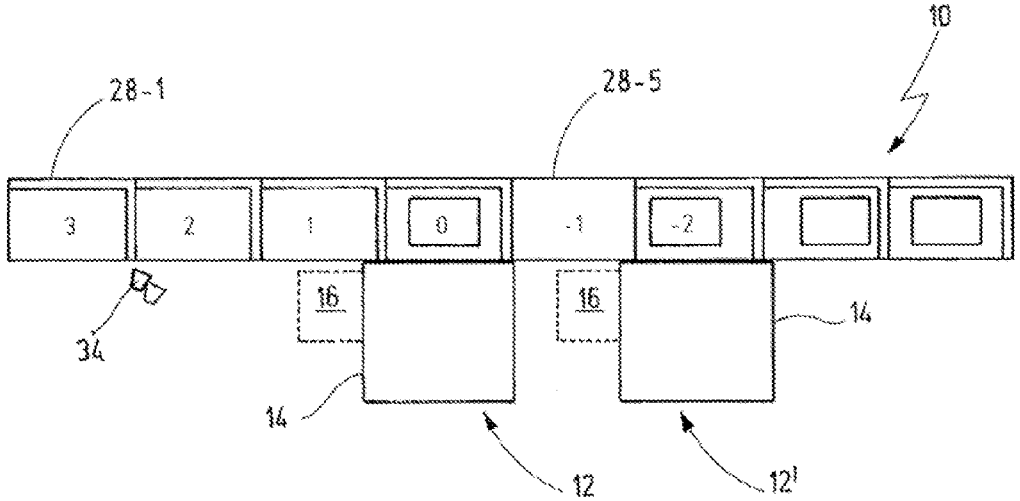
FIG. 9 shows the order-picking system of FIG. 1 having two document insertion apparatuses in accordance with the present invention.

In FIG. 9 the order-picking system 10 of FIG. 1 is shown with an additional document insertion apparatus 12'. As it will be explained hereinafter in greater detail, the throughput of containers 30 at the time of inserting the documents can be significantly increased in this manner, if the documents 32 merely comprise a very small number of sheets (in average less than two).

The first document insertion apparatus 12 is again facing the conveyor segment 28-4. The second document insertion apparatus 12' is arranged adjacent to the conveyor segment 28-6. Thus, one conveyor segment (28-5) is located between the first and second document insertion apparatuses 12, 12'. This conveyor segment 28-5 is required, in order to be able to provide the spatial space for the paper storage 16 of the second document insertion apparatus 12' (accessibility for the purpose of filling). If the paper storage 16 of the second document insertion apparatus 12' were arranged on the right-hand side relative to the printer 14, the first and second document insertion apparatuses 12 and 12' could also adjoin each other directly, for example adjacent to the conveyor segments 28-4 and 28-5. Alternatively, the second (or a third) document insertion apparatus 12' could also be arranged on the opposite side of the conveyor 26, if a direct subsequent arrangement of the document insertion apparatus is desired. In this case, the system would, however, be somehow broader as it is the case with the solution of FIG. 9.

The container identification sensor 34 is arranged about the length of two conveyor segments 28 upstream relative to the first document insertion apparatus 12, in order to allow signalling to the document insertion apparatus 12, 12' the container 30, which just arrives.

It is clear that even a so-called accumulation conveyor can be used as the conveyor segments 28 so that the length of one conveyor segment 28 along the streaming direction is also designated as an accumulation length in an equivalent manner.

In this manner, respectively one container 30 can be identified immediately in front of the document insertion apparatuses 12, 12' for each of the document insertion apparatus 12 and 12' by means of the container identification sensor 34. The first container 30, which passes the sensor 34, is fed to the second document insertion apparatus 12' by travelling through the first document insertion apparatus 12. The second container 30, which passes the sensor 34, is fed to the first document insertion apparatus 12, and therefore stops briefly at the first document insertion apparatus 12, in order to allow receipt of the document 32.

Figure 10:
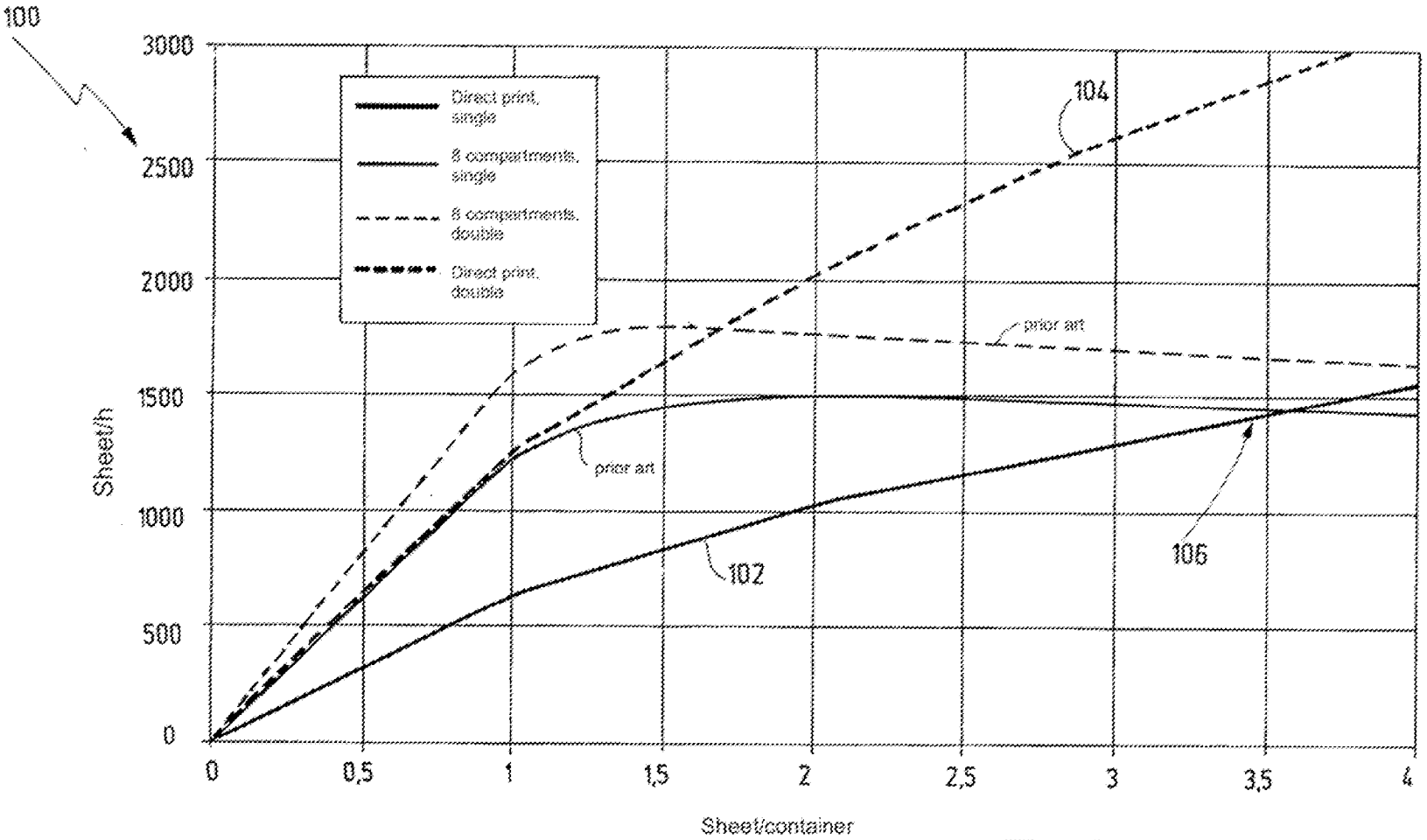
FIG. 10 shows a graph for illustrating differences between conventional document insertion apparatuses and such of the present invention, if provided once and twice.

With reference to FIG. 10 a graph 100 is shown depicting an insertion frequency (sheet/h) against an average number of sheets for each container (sheet/container). Four curves are shown, wherein dark lines represent curves in accordance with the invention and light lines represent curves according to the prior art (prior art). The dark solid line 102 represents the efficiency of the invention if one single document insertion apparatus 12 is provided, as shown in FIG. 1. The dark broken line 104 represents the invention, if two document insertion apparatuses 12, 12', are (sequentially) provided as shown, for example, in FIG. 9. The light solid line "prior art" shows the efficiency of a conventional (single) document printer having a document magazine for storing 8 documents. The light broken line "prior art" shows the efficiency of a conventional system which is provided with two document magazines respectively storing 8 documents.

A comparison of the solid lines reveals that the invention is more efficient at an average number of 3.5 for each container, if compared to a single conventional document printer. However, if a conventional single document printer is compared to a double document insertion apparatus (cf. FIG. 9), both in accordance with the present invention, then both document insertion systems are almost equal up to a number of one sheet for each container. At higher number of sheets for each container the system of the present invention is significantly superior to the prior art.

The acquisition costs for the starting up of a double system in accordance with the present invention are slightly beneath the costs of a single prior art system. Although two printers 14 are required with the double system of the present invention, these additional costs are almost compensated by much lower costs for the document guiding devices 40 of the present invention. Additionally, considering that the present invention does not require an preparation line, i.e. does not require several conveyor segments in front of the printers, one arrives with the present invention including a double printer equipment at overall costs which are slightly lower than a prior art single equipment. Then, if one considers the much higher performance (curve 104) it is clear that the system and method of the present invention are significantly better.

Another advantage, at almost the same investment costs, is to be seen in that redundancy is achieved due to the two printers of the present invention which is not possible with a prior art magazine being adapted to receive 8 sheets being only provided one time. Another advantage is to be seen in the space saving since the present invention no longer requires a preparation line. The containers are identified directly in front of the printers 14. In particular, the present invention is significantly better than the prior art if the number of sheets for each container is greater than 2.

Figure 11:
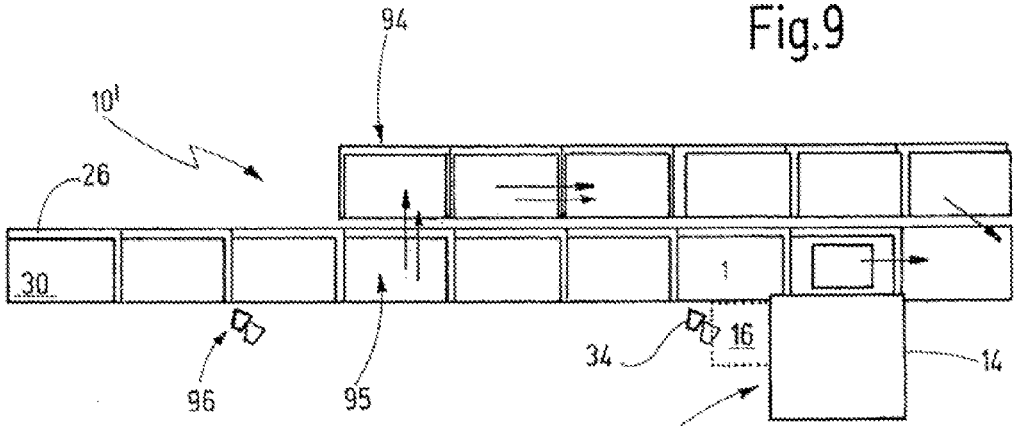
FIG. 11 shows a modified order-picking system including a bypass conveyor.

With reference to FIG. 11 a variation is shown in comparison to the FIGS. 1 and 9. In FIG. 11 the document insertion apparatus 12, which is identical to the one in FIG. 1, is arranged at the end of an order-picking system 10', i.e. close to a goods issue, because invoices are to be added as the documents 32. An invoice is not added to each one of the containers 30. An invoice is only added to the last container 30 of an order series. A second conveyor 94 is provided, in this case being provided parallel to the first conveyor 26 and bypassing the printer 14, in order to avoid the need of guiding all of the containers of the order past the printer 14 of the document insertion apparatus 12, which would represent a throughput bottleneck (containers/hour).

With the exception of the last container 30 of a container series, which in this case actually receives the documents, all of the preceding containers 30 of the series are discharged at a discharging point 95, for example, by means of a pusher (not shown) to the second conveyor 94. For this purpose another sensor 96 for identifying the containers is provided one accumulation length in front of the discharging point 95.

The throughput in turn can be increased strongly in the entire system by only guiding "last" containers 30 of the series past the document insertion apparatus 12.

Also, of course only the last container could be discharged because the number of the "last" containers is low, as expected.

Figure 12:
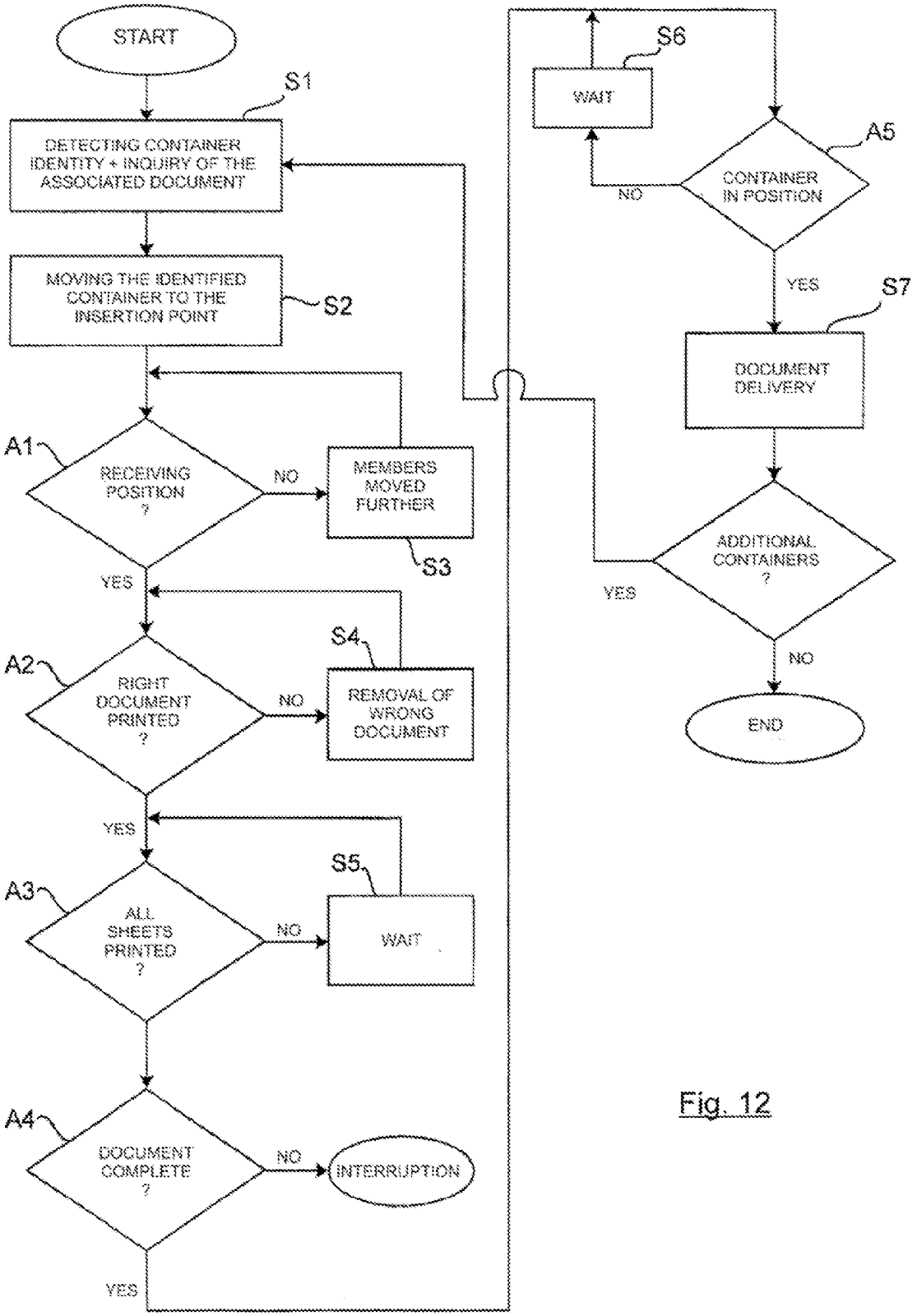
FIG. 12 shows a flow chart of the method of document insertion into a load support according to the present invention.

FIG. 12 shows a flow chart of the method of the invention for inserting a document 32 to a container 30. In a first step S1, the container identification is detected by means of the first sensor 34, and then the associated document 32 is retrieved by at least one of the controlling devices 18 and 20. Then the identified container 30 is moved to the insertion point (conveyor segment directly following one of the document insertion apparatuses 12, 12') (step S2). Then it can be checked in step S3 whether the receiving members 42, 44 are in the receiving position (inquiry A1). If the receiving members 42, 44 are not yet in the receiving position, they can be moved further into the receiving position (step S3). With another inquiry A2 it can be checked by means of the sensor 66 (cf. FIG. 3) whether the right document 32 was printed or is printed. If the wrong document 32 was printed or is printed, for example, because the bar code does not match the associated container 30, the wrong document 32 needs to be removed in a step S4. The removal can happen manually or in an automated manner in a station being located downstream relative to the last document insertion apparatus.

In another inquiry A3 it is checked whether all of the sheets or pages of the document 32 are printed. If not yet all of the sheets are printed, it is waited for in step S5. If all of the pages are printed, it is checked in an inquiry A4 whether the document 32 is complete. In the inquiry A4 once again each information being relevant to the document can be checked such as the document number, container number, number of sheets and similar. If the document 32 is not complete, the document insertion is interrupted or can be initiated once again beginning at the step S1.

However, if the document 32 is complete, then it can be checked in another inquiry A5 whether the identified container 30 is in the insertion position, i.e. if it is located on the conveyor segment directly following the document insertion apparatus 12. Since the document identification happens immediately in front of the document insertion, one needs to wait for one of the containers 30 very rarely (step S6).

If one of the containers 32 is in its document insertion position the document 32 can be delivered by the document insertion apparatus 12 or 12' to the container 30 in a step S7. Subsequently, it can be checked in another inquiry A6 whether additional containers 30 need to be provided with documents 32. If no additional containers 30 are to be provided with documents 32 the method in accordance with the present invention ends. Otherwise, one returns to the step S1.

Therefore, what we claim is:

1. A document insertion apparatus for automatically inserting documents into load supports which are transported downstream by means of a conveyor through an order-picking system, the document insertion apparatus comprising:

a document guiding device being configured to store a document, and to mechanically guide the document into a load support, which is assigned to the document based on an picking order and which automatically passes the document insertion apparatus on the conveyor such that the document is movable into the assigned load support;

at least one sensor, a first sensor of which is adapted and arranged such that each load support passing the first sensor on the conveyor, including the assigned load support, is identified upstream relative to the document guiding device; and a controlling device being connected to the at least one sensor, the controlling device being configured to output a document-print command to a printer in dependence on an identification signal from the first sensor, thereby causing print of the document and hand over of the printed document to the document guiding device;

wherein the document guiding device comprises receiving members, wherein the receiving members are movably arranged substantially opposite to each other, and the receiving members are configured and arranged to receive the printed document in a receiving position, which is defined by a space between the oppositely arranged receiving members; and wherein the document guiding device further comprises an actuating member which is adapted to move the receiving members from the receiving position to a delivery position in which the printed document is delivered to the assigned load support in a mechanically guided manner.

2. The document insertion apparatus of claim 1, wherein a type of the load supports, into which the document is to be inserted, is selected from a group consisting of containers, trays, cardboard boxes and bins.

3. The document insertion apparatus of claim 1, wherein the receiving members are arranged oppositely to each other in a horizontal orientation.

4. The document insertion apparatus of claim 1, wherein the document guiding device is configured to store one single document at a time.

5. The document insertion apparatus of claim 1, wherein the receiving members respectively comprise bucket wheels, each bucket wheel comprising several buckets which are mounted in a rotatable manner, herein in the receiving position each of the buckets is closed towards the assigned load support.

6. The document insertion apparatus of claim 5, wherein the bucket wheels are actuated by means of one single drive such that the bucket wheels rotate from the receiving position to the delivery position in respectively oppositely orientated directions of rotation.

7. The document insertion apparatus of claim 6, wherein each of the bucket wheels is always rotated in the respectively same direction for arriving at the respective delivery position.

8. The document insertion apparatus of claim 6, wherein the one single drive comprises an electric motor.

9. The document insertion apparatus of claim 5, wherein each of the bucket wheels is moved by a traction device being guided around parallel axes of the bucket wheels in a respectively opposite direction of rotation.

10. The document insertion apparatus of claim 9, wherein the traction device comprises one single drive belt.

11. The document insertion apparatus of claim 1, wherein the receiving members comprise flaps, which are supported pivotally in a frame of the document insertion apparatus.

12. The document insertion apparatus of claim 11, wherein the pivotal flaps are movable to the delivery position by means of a stamp, and are movable to the receiving position by means of a return mechanism.

13. The document insertion apparatus of claim 12, wherein the return mechanism comprises a spring device.

14. The document insertion apparatus of claim 1, further comprising a second sensor, which is arranged and adapted such that a number of sheets belonging to the document are counted, wherein the controlling device is adapted to interrupt the insertion of the document in dependence on a count signal from the second sensor, if the number of the sheets deviates from a predetermined number, or to cause the document insertion, if the number of the sheets corresponds to the predetermined number.

15. The document insertion apparatus of claim 1, further comprising a third sensor, which is arranged and adapted such that the third sensor verifies whether a document located in the receiving members corresponds to the document of the assigned load support.

16. The document insertion apparatus of claim 1, further comprising a fourth sensor, which is arranged and adapted such that the fourth sensor verifies whether the receiving members are in receiving position or delivery position as required.

17. The document insertion apparatus of claim 1, wherein further a document printer is provided, which is arranged such that printed document sheets can be delivered directly to the receiving members.

18. An order-picking system comprising at least one document insertion apparatus, and a conveyor for transporting load supports past the document insertion apparatus, wherein the at least one insertion apparatus shares one single first identification sensor which is arranged at least one accumulation length downstream relative to a first document insertion apparatus, wherein each of the at least one document insertion apparatus comprises:

a document guiding device being configured to store a document, and to mechanically guide the document into a load support, which is assigned to the document based on an picking order and which automatically passes the document insertion apparatus on the conveyor such that the document is movable into the assigned load support, at least one sensor, a first sensor of which is adapted and arranged such that each load support passing the first sensor on the conveyor, including the assigned load support, is identified upstream relative to the document guiding device; and a controlling device being connected the at least one sensor, the controlling device being configured to output a document-print command to a printer in dependence on an identification signal from the first sensor, thereby causing print of the document and hand over of the printed document to the document guiding device;

wherein the document guiding device comprises receiving members, wherein the receiving members are movably arranged substantially opposite to each other, and the receiving members are configured and arranged to receive the printed document in a receiving position, which is defined by a space between the oppositely arranged receiving members; and wherein the document guiding device further comprises an actuating member which is adapted to move the receiving members from the receiving position to a delivery position in which the printed document is delivered to the assigned load support in a mechanically guided manner.

19. The order-picking system of claim 18, wherein the at least one document insertion apparatus is bypassed by another conveyor, if invoices are to be printed as the document.

20. A method for automatically inserting a document into a load support assigned to the document, comprising the following steps:

detecting a load support identification number of a load support on a conveyor upstream relative to a document insertion apparatus, the conveyor passing the document insertion apparatus;

requesting a document being assigned to the load support identification number from a controlling device;

printing the assigned document by means of a printer device and delivering the printed document to a document guiding device of the document insertion apparatus;

checking whether the printed document is complete;

delivering the printed document, if it is complete;

wherein the step of delivering comprises moving of receiving members of the document guiding device in opposite directions so that the printed document is mechanically guided into the assigned load support.

21. A document insertion apparatus for automatically inserting documents into load supports which are transported downstream by means of a conveyor through an order-picking system, the document insertion apparatus comprising:

a document guiding device being configured to store a document, and to mechanically guide the document into a load support, which is assigned to the document based on an picking order and which automatically passes the document insertion apparatus on the conveyor such that the document is movable into the assigned load support, at least one sensor, a first sensor of which is adapted and arranged such that each load support passing the first sensor on the conveyor, including the assigned load support, is identified upstream relative to the document guiding device;

a printer; and a controlling device being connected the printer and the at least one sensor, the controlling device being configured to output a document-print command to a printer in dependence on an identification signal from the first sensor, thereby causing print of the document and hand over of the printed document to the document guiding device;

wherein the document guiding device comprises receiving members, wherein the receiving members are movably arranged substantially opposite to each other, and the receiving members are configured and arranged to receive the printed document in a receiving position, which is defined by a space between the oppositely arranged receiving members; and wherein the document guiding device further comprises an actuating member which is adapted to move the receiving members from the receiving position to a delivery position in which the printed document is delivered to the assigned load support in a mechanically guided manner.

* * * * *